US007815467B2

(12) United States Patent
Tsuchida et al.

(10) Patent No.: US 7,815,467 B2
(45) Date of Patent: Oct. 19, 2010

(54) CONNECTOR DEVICE

(75) Inventors: Masahiro Tsuchida, Tokyo (JP); Takashi Sawai, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/539,067

(22) Filed: Aug. 11, 2009

(65) Prior Publication Data

US 2010/0055984 A1 Mar. 4, 2010

(30) Foreign Application Priority Data

Sep. 1, 2008 (JP) ..... 2008-223548

(51) Int. Cl.
*H01R 13/648* (2006.01)

(52) U.S. Cl. ..... 439/607.09; 439/579

(58) Field of Classification Search ..... 439/579, 439/660, 607.09, 607.35, 607.36
See application file for complete search history.

(56) References Cited

U.S. PATENT DOCUMENTS 5,662,480 A * 9/1997 Togashi ..... 439/63
5,697,799 A * 12/1997 Consoli et al. ..... 439/181
6,500,013 B1 * 12/2002 Wang ..... 439/108
7,168,986 B1 * 1/2007 Peng ..... 439/607.04
7,207,842 B1 * 4/2007 Kenjo ..... 439/607.01
7,367,820 B2 * 5/2008 Kikuchi ..... 439/108

FOREIGN PATENT DOCUMENTS

JP 2008-147020 A 6/2008

* cited by examiner

*Primary Examiner*—Thanh-Tam T Le
(74) *Attorney, Agent, or Firm*—Kubotera & Associates LLC

(57) ABSTRACT

A connector device includes a first connector and a second connector to be connected the first connector. The first connector includes a first housing, a plurality of first signal terminals arranged in the first housing, and a first shell for covering an outer portion of the first housing. The second connector includes a second housing, a plurality of second signal terminals arranged in the second housing, a second shell for covering an outer portion of the second housing, and a first ground terminal disposed between the second signal terminals for separating the second signal terminals. When the first connector is connected the second connector, the first signal terminals contact with the second terminals.

11 Claims, 8 Drawing Sheets

CONNECTOR DEVICE

BACKGROUND OF THE INVENTION AND RELATED ART STATEMENT

The present invention relates to a connector device having a shielding function.

These days, a signal is transmitted at a faster signal speed. When the signal speed becomes faster, a noise problem becomes more apparent. Especially when a high-frequency signal is transmitted, the noise problem becomes a serious issue. Japanese Patent Publication, for example, has disclosed a conventional connector device having a high shielding function against an electromagnetic disturbance or static electricity in order to resolve the noise problem. Patent Reference: Japanese Patent Publication No. 2008-147020

In the conventional connector device disclosed in Patent Reference, some of a plurality of terminals maintain a shape approximately the same as that of the other terminals, and are used as a ground terminal instead of a signal terminal, thereby increasing a shielding performance thereof. In the conventional connector device described above, however, it is difficult to obtain a sufficient shielding function for each of the signal terminals.

In view of the problems described above, an object of the present invention is to provide a connector device with a higher shielding function for each signal terminal, thereby making it possible to effectively transmit a high-frequency signal.

SUMMARY OF THE INVENTION

In order to attain the objects described above, according to the present invention, a connector device includes a first connector and a second connector to be connected to the first connector. The first connector includes a first housing; a plurality of first signal terminals arranged next to each other in the first housing; and a first shell for covering an outer portion of the first housing.

The second connector includes a second housing; a plurality of second signal terminals arranged next to each other in the second housing; and a second shell for covering an outer portion of the second housing. When the first connector is connected to the second connector, the first signal terminals contact to the second signal terminals, respectively. The second housing further includes a ground terminal for separating the second signal terminals from each other.

In the connector device described above, the second housing may further include two ground terminals being arranged on both sides of the plurality of the second signal terminals.

Further, in the connector device described above, the first housing may further include a slit for separating each of the plurality of the first signal terminals arranged next to each other. When the first connector is connected to the second connector, the slit may receive the ground terminal, thereby separating each of the plurality of the first signal terminals arranged next to each other.

In addition, in the connector device described above, the ground terminals may be arranged on both sides of the plurality of the first signal terminals when the first connector is connected to the second connector.

According to the present invention, the ground terminal may have a plate-like shape. The second connector may include a recess portion for receiving a protruding portion with the first signal terminals provided thereon when the first connector is connected to the second connector. The ground terminal having the plate-like shape may protrude toward the recess portion and enter the slit to separate each of the plurality of the first signal terminals arranged next to each other when the first connector is connected to the second connector.

In the connector device described above, it is preferable that the second shell covers a side portion of the second housing.

In the connector device described above, it is preferable that the first shell covers an upper portion of the second housing when the first connector is connected to the second connector.

Further, in the connector device described above, it is preferable that the ground terminal connects to the second shell electrically.

In the connector device described above, it is preferable that the first shell and the second shell connect to each other when the first connector is connected to the second connector.

DETAILED DESCRIPTION OF THE PREFERRED EMBODIMENTS

Hereunder, embodiments of the present invention will be explained with reference to the accompanying drawings.

First Embodiment

Figure 1:
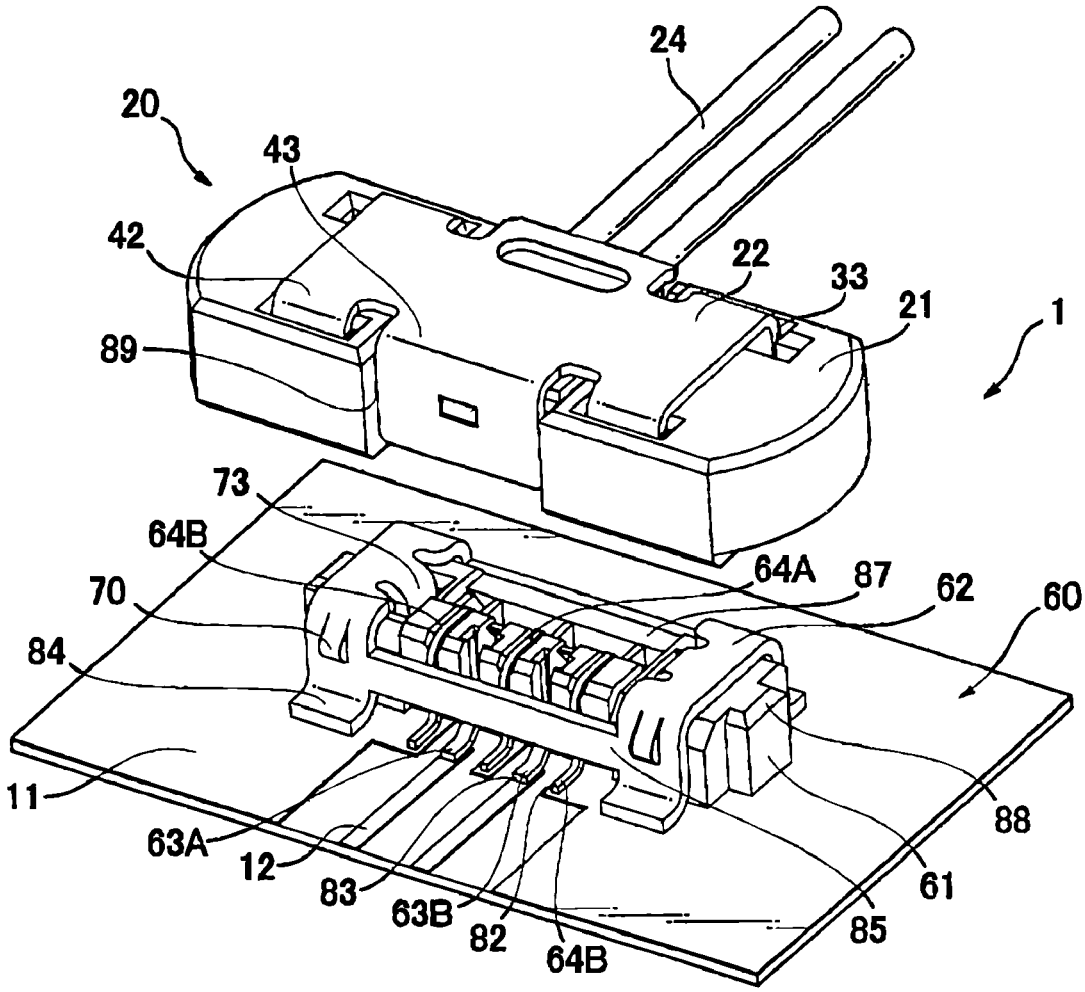
FIG. 1 is a perspective view showing a plug connector and a receptacle connector in a state before the plug connector is connected to the receptacle connector according to a first embodiment of the present invention.
Figure 2:
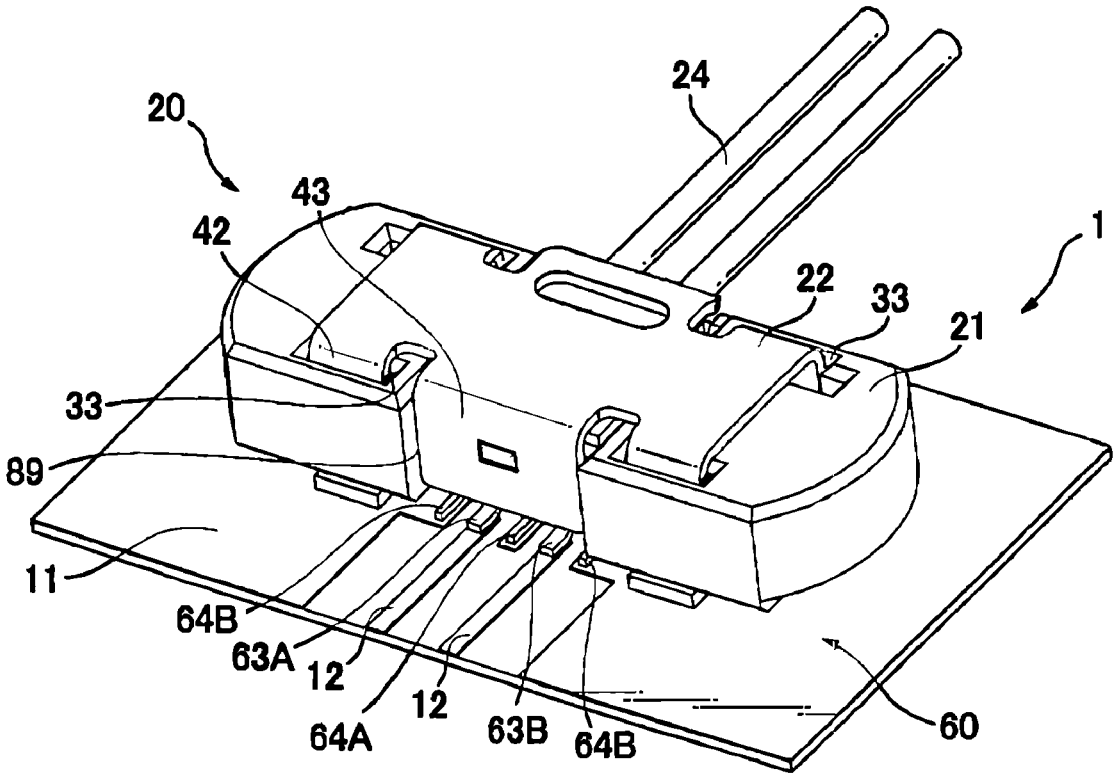
FIG. 2 is a perspective view showing the plug connector and the receptacle connector in a state after the plug connector is connected to the receptacle connector according to the first embodiment of the present invention.

A first embodiment of the present invention will be explained. FIG. 1 is a perspective view showing a plug connector 20 and a receptacle connector 60 in a state before the plug connector 20 is connected to the receptacle connector 60 according to a first embodiment of the present invention. FIG. 2 is a perspective view showing the plug connector 20 and the receptacle connector 60 in a state after the plug connector 20 is connected to the receptacle connector 60 according to the first embodiment of the present invention.

As shown in FIGS. 1 and 2, a connector device 1 includes the plug connector (a first connector) 20 and the receptacle connector (a second connector or a receptacle) 60 to be connected to the plug connector 20. In the embodiment, the plug connector 20 is connected a coaxial cable 24 and the receptacle connector 60 is connected to a print board 11. In the present invention, it is not limited to a configuration described above.

Between the plug connector 20 and the receptacle connector 60, more specifically, between the coaxial cable 24 and the print board 11, a high-frequency signal, for instance, is transmitted when the plug connector 20 is connected to the receptacle connector 60. The print board 11 may have ground on an approximate entire surface thereof except a signal line 12, in order to transmit the high-frequency signal and block a noise.

Figure 3:
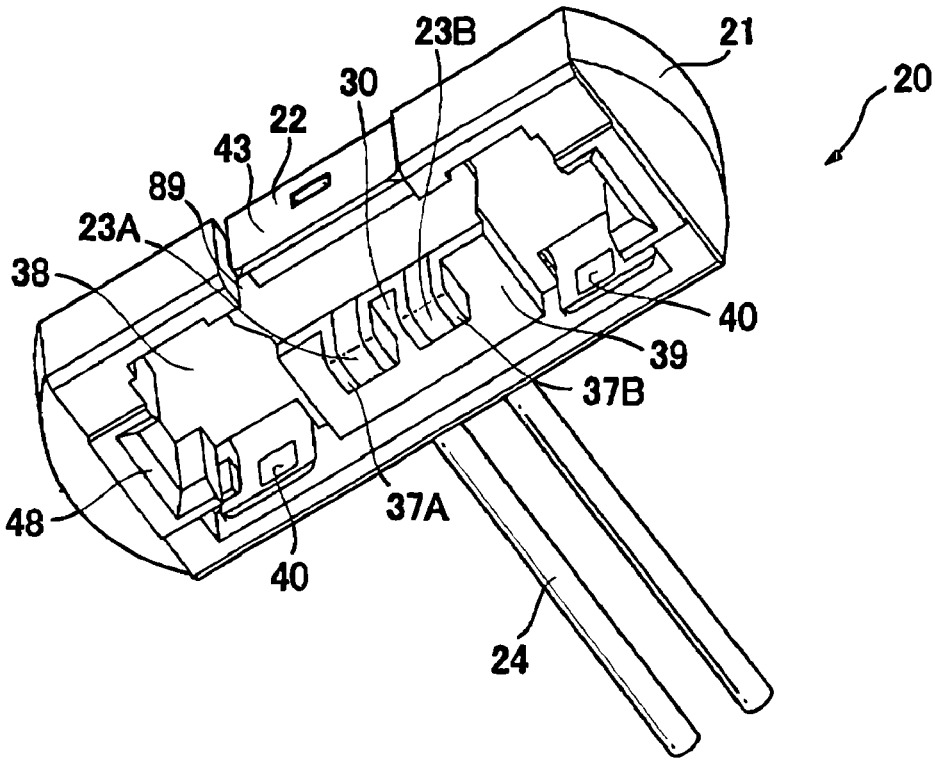
FIG. 3 is a bottom perspective view showing the plug connector according to the first embodiment of the present invention.
Figure 4:
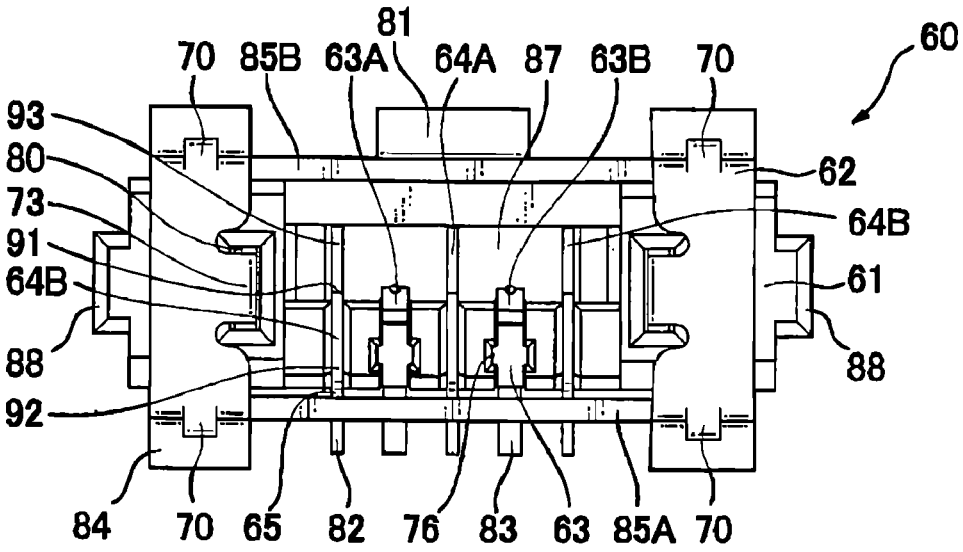
FIG. 4 is a top view showing the receptacle connector according to the first embodiment of the present invention.

FIG. 3 is a bottom perspective view showing the plug connector 20 according to the first embodiment of the present invention. FIG. 4 is a top view showing the receptacle connector 60 according to the first embodiment of the present invention.

As shown in FIGS. 3 and 4, the plug connector 20 includes a fitting recess 38 for receiving the receptacle connector 60 in a bottom side thereof. When the plug connector 20 is connected to the receptacle connector 60, an approximate whole portion of the receptacle connector 60 is settled into an inside of the fitting recess 38 of the plug connector 20. Accordingly, the plug connector 20 covers the receptacle connector 60 from an upper direction. In order to connect smoothly, the plug connector 20 may include a taper portion 48 nearby a connection starting position thereof and the receptacle connector 60 may include a taper portion 88 nearby a connection starting position thereof, respectively.

Further, in order to maintain the plug connector 20 and the receptacle connector 60 in a connecting state, the plug connector 20 may include a recess portion 40 for locking. The receptacle connector 60 may include a protruding portion 70 capable of locking the plug connector 20 with the receptacle connector 60 by engaging with the recess portion 40.

The plug connector 20 mainly includes a plug housing (a first housing) 21, a plurality of plug signal terminals (first signal terminals) 23 arranged in the plug housing 21 next to each other, and a plug shell (a first shell) 22 covering an outer portion of the plug housing 21.

The plug shell 22 and the plug signal terminal 23 are fixed to the plug housing 21. The plug shell 22 includes a press fit portion 42 extending toward a lower direction and a bent portion 43. The plug shell 22 can be fixed to the plug housing 21 with the press fit portion 42 thereof forcibly inserted into a press fit hole 33 of the plug housing 21 and the bent portion 43 thereof bent with a pressure toward a corresponding recess 89 provided on a front side of the plug housing 21.

In addition, the plug signal terminal 23 can be fixed to the plug housing 21 or can be molded integrally with the housing 21. For example, the plug signal terminal 23 is fitted into a protruding portion 37 protruding from a step portion 39 provided at an approximate center portion of the fitting recess 38, thereby fixing to the plug housing 21. The plug connector 20 further includes a slit 30 for receiving a ground terminal 64A of the receptacle connector 60. The slit 30 opens in a connecting direction of the plug connector 20 and the receptacle connector 60. The slit 30 is provided between the protruding portions 37A and 37B for fixing the plug signal terminals 23A and 23B next to each other.

Figure 5:
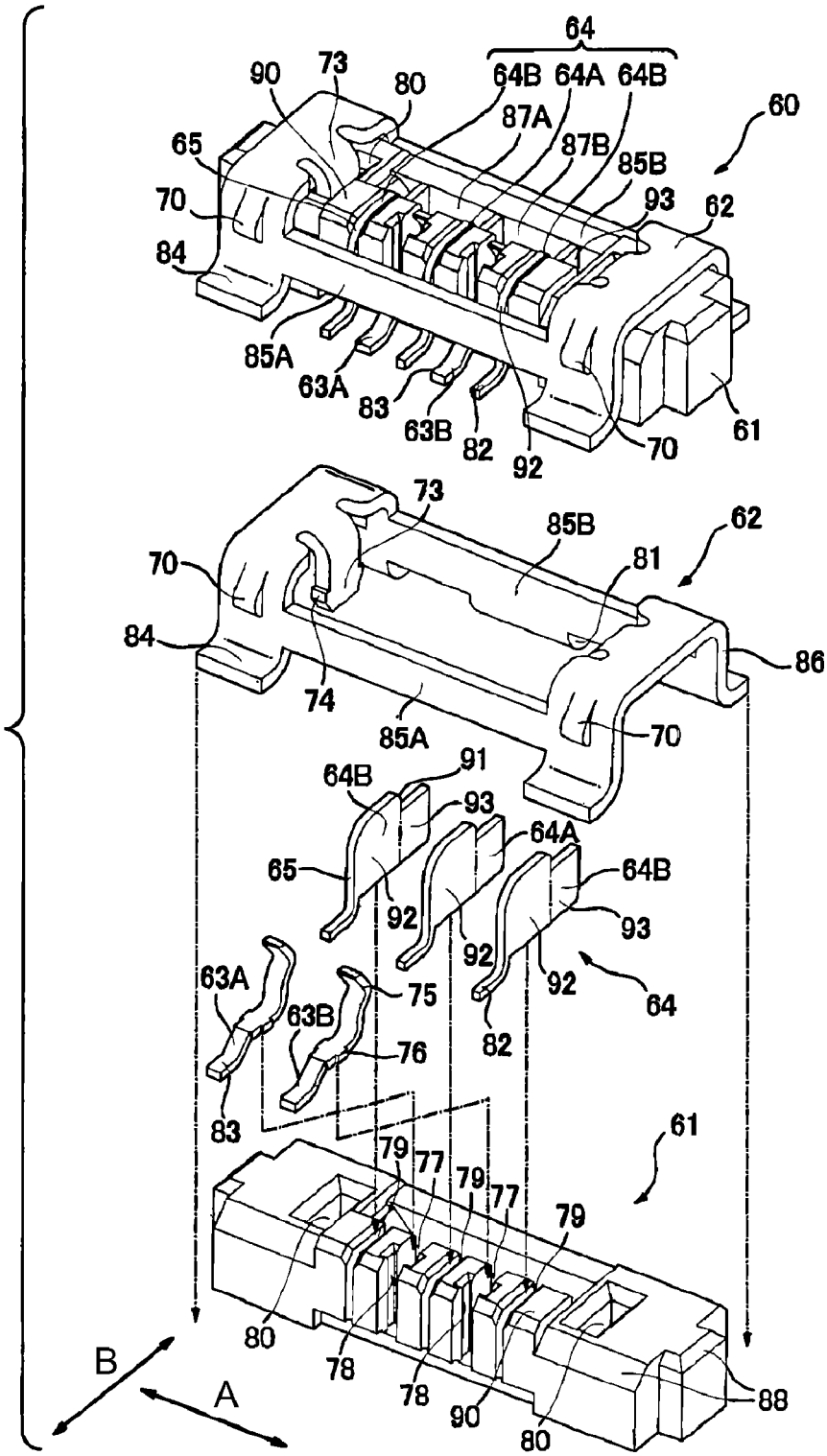
FIG. 5 is an exploded perspective view showing the receptacle connector according to the first embodiment of the present invention.

FIG. 5 is an exploded perspective view showing the receptacle connector 60 according to the first embodiment of the present invention. As shown in FIG. 5, the receptacle connector 60 mainly includes a receptacle housing (a second housing) 61, a plurality of receptacle signal terminals (second signal terminals) 63, a ground terminal 64 and a receptacle shell (a second shell) 62. The receptacle signal terminals 63 are aligned to be next to each other in the receptacle housing 61.

The ground terminal 64 separates each of the receptacle signal terminals 63 and either of outer end of the receptacle signal terminals 63 in a direction of an arrow B, perpendicular to a direction shown with an arrow A or an aligning direction of the receptacle signal terminals 63. The receptacle shell 62 covers an outer portion of the receptacle housing 61.

As a whole, the receptacle housing 61 has an approximate rectangular shape. The receptacle housing 61 includes a terminal aligning portion 90 at a central area thereof and along a longitudinal direction thereof. The receptacle signal terminal 63 and the ground terminal 64 are aligned in the terminal aligning portion 90. In addition, the receptacle housing 61 includes a recess portion 87. The recess portion 87 receives the protruding portion 37 having the plug signal terminal 23 when the plug connector 20 is connected the receptacle connector 60.

The receptacle housing 61 further includes a push-in hole 80 at an either end portion of the terminal aligning portion 90 and the recess portion 87. The push-in hole 80 fixes the receptacle shell 62 to the receptacle housing 61, by pushing a push-in portion 73 of the receptacle shell 62 therein.

For example, the receptacle signal terminal 63 has a plate-like shape with a predetermined width in the aligning direction of the receptacle signal terminals 63 (shown with the arrow A in FIG. 5). The receptacle signal terminal 63 is formed by punching out and then bending a flat metal plate. The receptacle signal terminal 63 has a cross sectional shape with an approximate L shape in the direction of the arrow B, perpendicular to the aligning direction of the receptacle signal terminal 63 (shown with the arrow A).

The receptacle signal terminal 63 includes a board mounting portion 83 for mounting on the print board 11 at one end thereof; a contact portion 75 as a contacting part with the plug signal terminal 23 of the plug connector 20 at another end thereof; and a push-in protrusion 76 at an approximate central portion thereof. The push-in protrusion 76 protrudes in a width direction thereof for pushing and fixing into the terminal aligning portion 90 of the receptacle housing 61. With a shape described above, the receptacle signal terminal 63 is capable of elastic contact with the plug signal terminal 23 of the plug connector 20.

The ground terminal 64 is formed by simply punching out a flat metal plate. Unlike the receptacle signal terminal 63, the ground terminal 64 is not bent to be formed. The ground terminal 64 has a thin plate portion having a thickness of the flat metal plate in the aligning direction of the receptacle signal terminal 63 and has a relatively larger area in the direction of the arrow B, perpendicular to the aligning direction of the receptacle signal terminals 63 (shown with the arrow A).

Due to the larger area, the ground terminal 64 is able to perform ground function thereof more efficiently. The ground terminal 64 includes a board mounting portion 82 at one end thereof with a stick shape for mounting on the print board 11. Except for the board mounting portion 82, the ground terminal 64 is a plate-like shape having an approximate rectangular figure. The ground terminal 64 further includes a step portion 91 at an upper central portion of the rectangular figure thereof.

A larger portion 92 and a smaller portion 93 are formed with the step portion 91. Both of the larger portion 92 and the smaller portion 93 separate the receptacle signal terminals 63 arranged next to each other in the direction of the arrow B, perpendicular to the aligning direction of the receptacle signal terminal 63 (shown with the arrow A). Furthermore, the smaller portion 93 also separates the plug signal terminals 23 arranged next to each other in the direction of the arrow B, perpendicular to the aligning direction of the receptacle signal terminal 63 (shown with the arrow A) when the plug connector 20 is connected to the receptacle connector 60 since the smaller portion 93 protrudes toward the recess portion 87. The step portion 91 corresponds to a step portion 45 of the plug housing 21.

The receptacle signal terminal 63 and the ground terminal 64 are aligned in the terminal aligning portion 90 of the receptacle housing 61. In the embodiment, the terminal aligning portion 90 includes two aligning grooves 77 for aligning the receptacle signal terminal 63 and three aligning grooves 79 for aligning the ground terminals 64. The aligning grooves 77 and 79 are situated alternately. The aligning grooves 79 are provided between the aligning grooves 77 and at positions sandwiching both outer sides of the aligning grooves 77, in the aligning direction of the receptacle signal terminal 63 (shown with the arrow A).

The receptacle signal terminal 63 and the ground terminal 64 can be placed into predetermined positions from an upper side of the receptacle housing 61 using the aligning grooves 77 and 79. Especially, receptacle housing 63 is pushed into the aligning groove 77 by engaging the push-in protrusion 76 thereof with a push-in groove 78 provided in the aligning groove 77. When the receptacle signal terminal 63 and the ground terminal 64 are settled into the aligning grooves 77 and 79 respectively, the receptacle terminals 63A and 63B arranged next to each other are separated by the ground terminal 64A in the direction of the arrow B, perpendicular to the aligning direction of the receptacle signal terminal 63 (shown with the arrow A).

The receptacle terminals 63A and 63B are also separated by the ground terminals 64B at both of the outer sides thereof, in the direction of the arrow B, perpendicular to the aligning direction of the receptacle signal terminal 63 (shown with the arrow A). Consequently, the ground terminal 64 having the relatively larger area shields the receptacle signal terminal 63 from other receptacle signal terminal 63 arranged next thereto and from an exterior. Accordingly, the receptacle signal terminal 63 can increase a shielding performance thereof remarkably.

The receptacle shell 62 includes the push-in portion 73 extending toward the lower direction thereof for fixing the receptacle housing 61 thereto and two horizontal arm portions 85A, 85B extending toward a longitudinal direction thereof. The receptacle shell 62 further includes a drooping portion 86 combining the push-in portion 73 with horizontal arm portion 85. The receptacle shell 62 covers not only the receptacle housing 61, but also lateral portions of the receptacle signal terminal 63 and the ground terminal 64 settled in the receptacle housing 61. Therefore, the receptacle shell 62 shields the lateral portions of the receptacle signal terminal 63 and the ground terminal 64 from the exterior.

In addition, when the plug connector 20 is connected to the receptacle connector 60, the receptacle signal terminal 63 is not only covered and shielded with the ground terminal 64. The receptacle signal terminal 63 and the ground terminal 64 are also covered and shielded approximate whole portions thereof with the receptacle shell 62, the plug shell 22 and the print board 11 having ground on the surface thereof.

The push-in portion 73 includes a push-in protrusion 74 at a forefront portion thereof. The push-in protrusion 74 protrudes toward an either side thereof. The receptacle shell 62 can be fixed to the receptacle housing 61 by pushing the push-in protrusion 74 into the push-in hole 80 of the receptacle housing 61. The horizontal arm portion 85B is situated at a back side, that is, a side where the board mounting portion 82 of the ground terminal 64 or the board mounting portion 83 of the receptacle signal terminal 63 is not situated.

As shown in FIG. 4 and FIG. 5, the horizontal arm portion 85B includes a board mounting portion 81 for soldering onto the print board 11. The drooping portion 86 also includes a board mounting portion 84 in a similar fashion. The drooping portion 86 further includes a projecting portion 70 corresponding to the recess portion 40 of the plug connector. The horizontal arm portion 85A located at a front side can contact a plate thickness portion 65 of the ground terminal 64 (especially the larger portion 92) with an inner surface thereof. As a result, the ground terminal 64 can be connected to ground through the board mounting portion 82, as well as being connected to ground through the receptacle shell 62.

When the plug connector 20 is connected to the receptacle connector 60, the plug shell 22 and receptacle shell 62 can contact to each other. Thus, the plug shell 22, the receptacle shell 62, the ground terminal 64 and the print board 11 are connected to ground as a whole. The ground terminal 64 is not necessarily provided as a component separated from the receptacle shell 62, as shown in the embodiment of the present invention. Since it is sufficient if the ground terminal 64 is connected to ground in some way, the ground terminal 64 may be provided with the receptacle shell 62 integrally.

Figure 6:
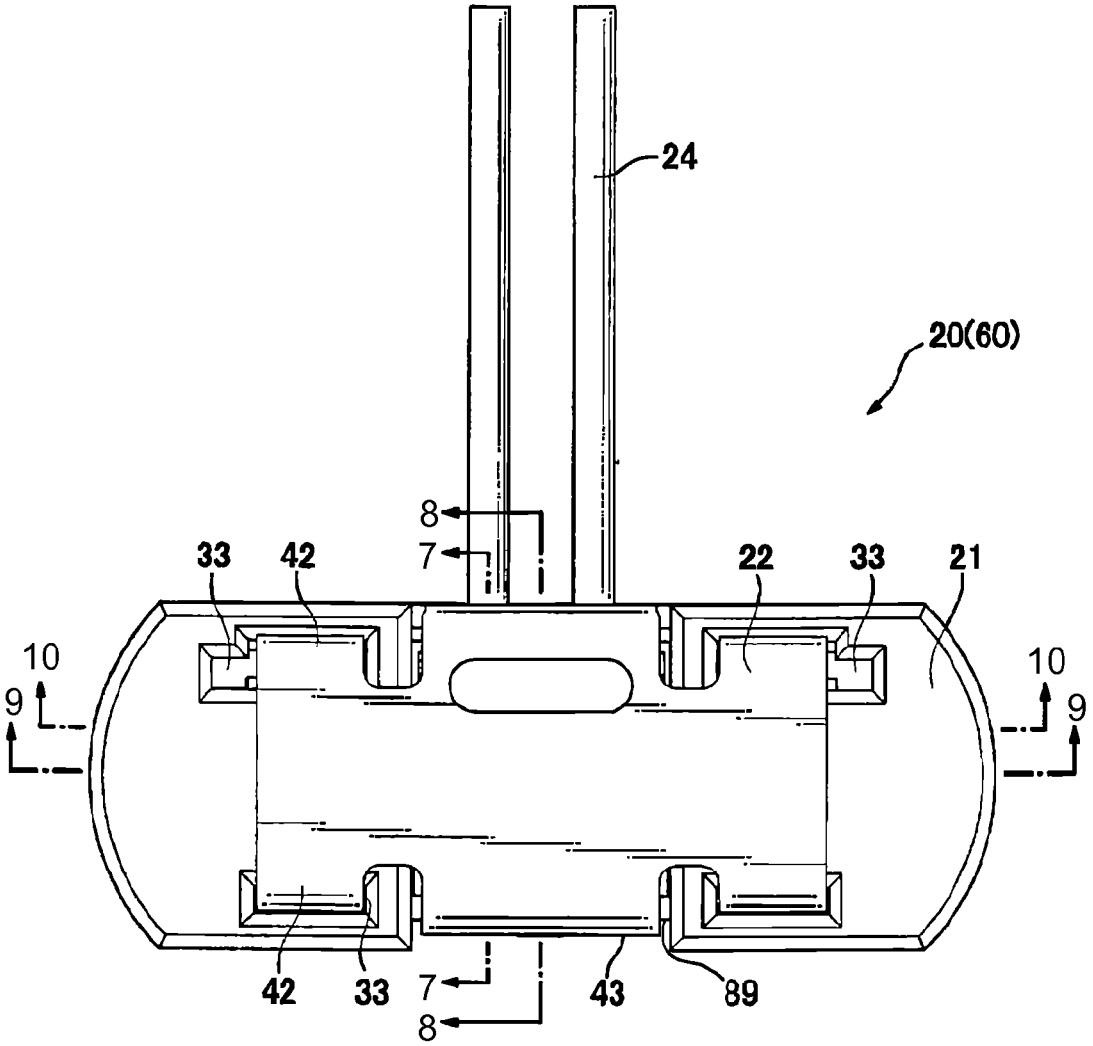
FIG. 6 is a top view showing the plug connector and the receptacle connector in a state before the plug connector is connected to the receptacle connector according to the first embodiment of the present invention.

FIG. 6 is a top view showing the plug connector 20 and the receptacle connector 60 in a state before the plug connector 20 is connected to the receptacle connector 60 according to the first embodiment of the present invention. Note that the receptacle connector 60 is not shown in FIG. 6 since the receptacle connector 60 is situated underneath the plug connector 20.

Figure 7:
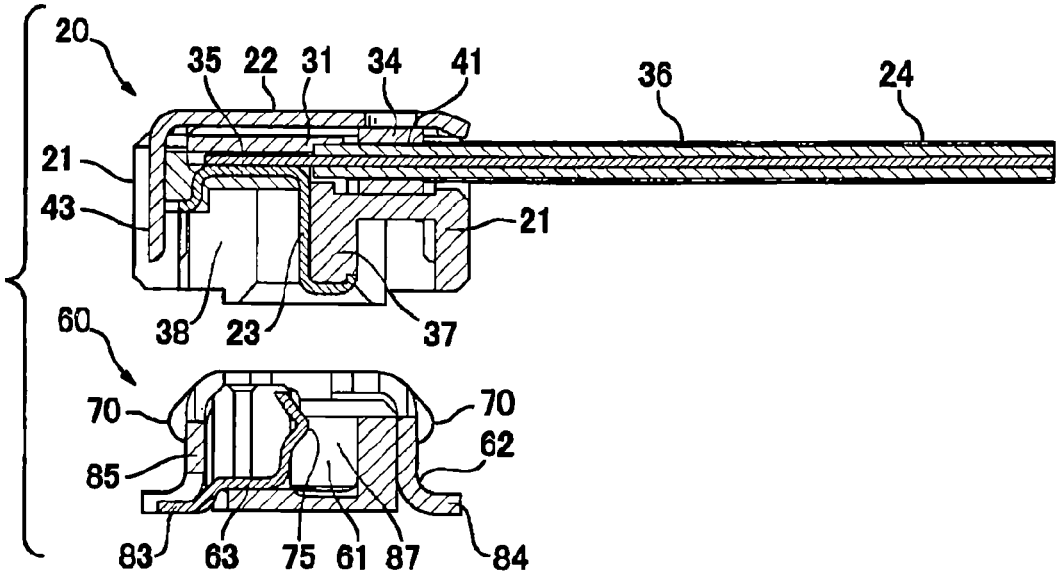
FIG. 7 is a sectional view showing the plug connector and the receptacle connector taken along a line 7-7 in FIG. 6 according to the first embodiment of the present invention.
Figure 8:
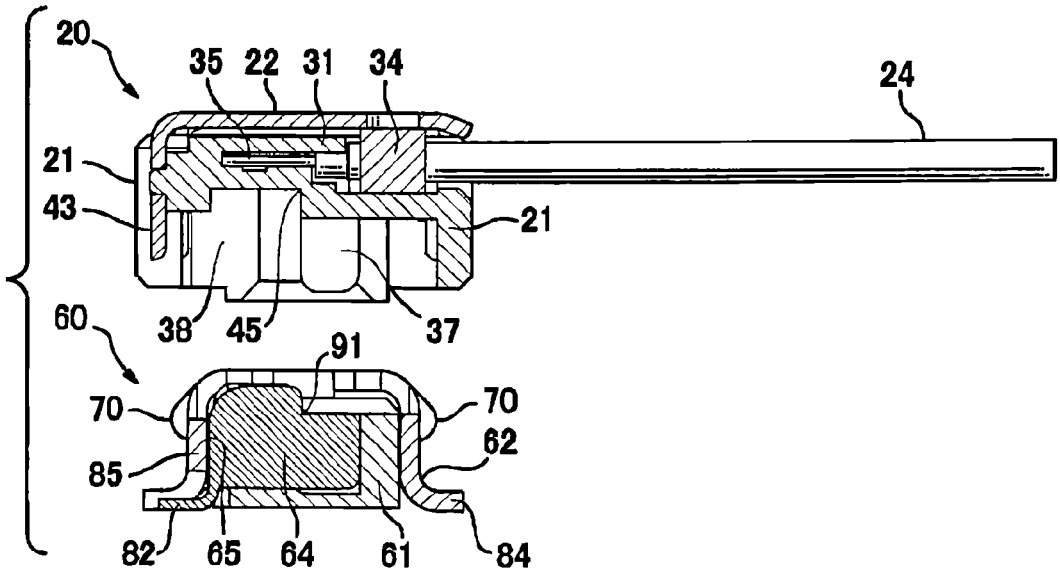
FIG. 8 is a sectional view showing the plug connector and the receptacle connector taken along a line 8-8 in FIG. 6 according to the first embodiment of the present invention.

FIG. 7 is a sectional view showing the plug connector 20 and the receptacle connector 60 taken along a line 7-7 in FIG. 6 according to the first embodiment of the present invention. FIG. 8 is a sectional view showing the plug connector 20 and the receptacle connector 60 taken along a line 8-8 in FIG. 6 according to the first embodiment of the present invention.

Figure 9:
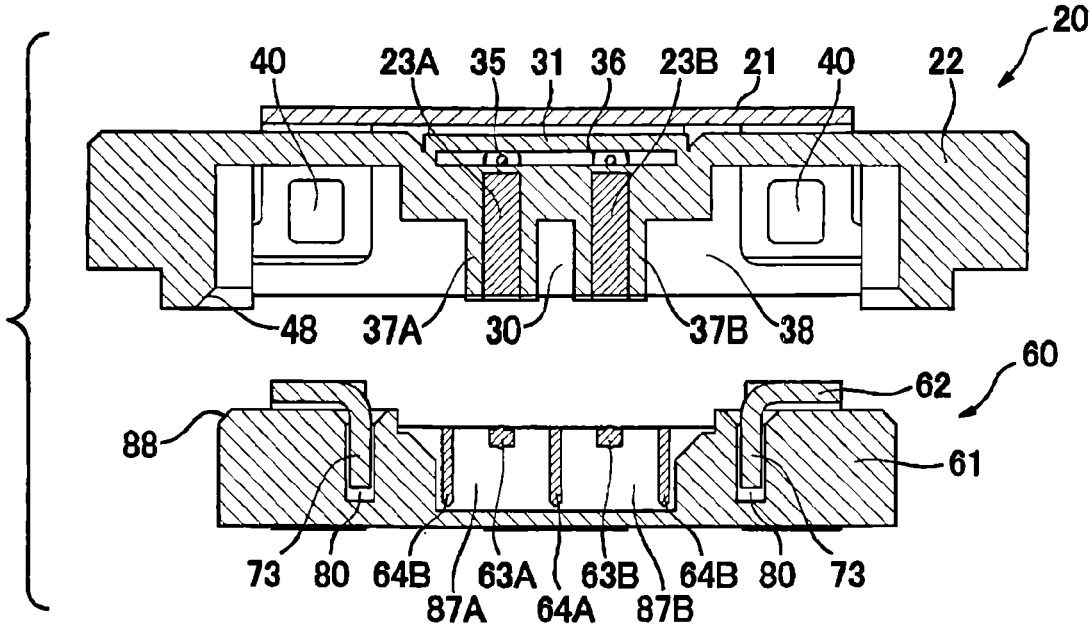
FIG. 9 is a sectional view showing the plug connector and the receptacle connector taken along a line 9-9 in FIG. 6 according to the first embodiment of the present invention.
Figure 10:
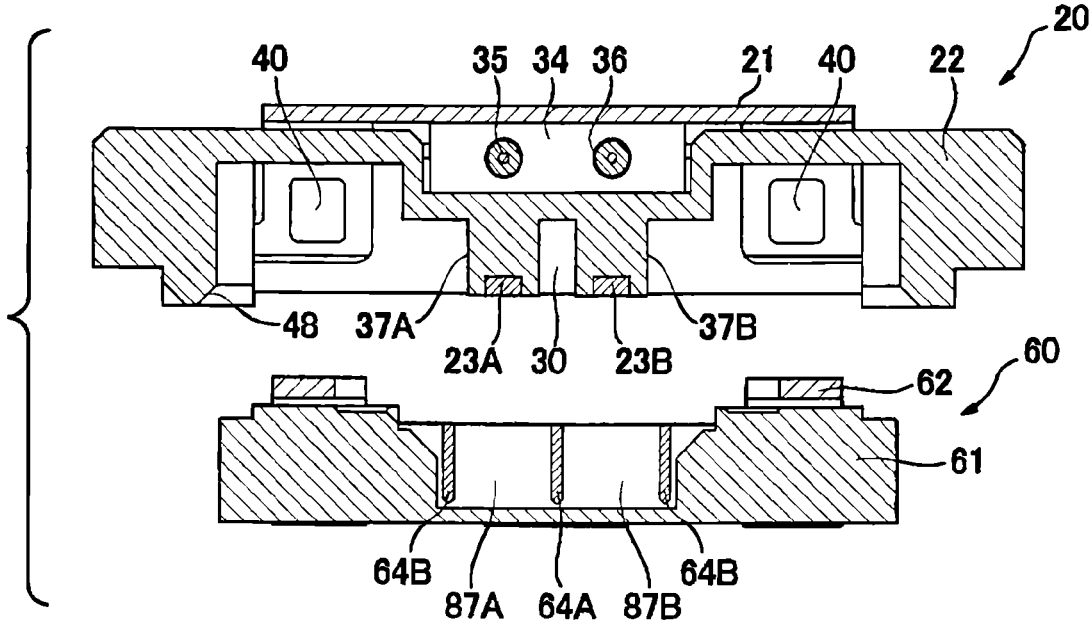
FIG. 10 is a sectional view showing the plug connector and the receptacle connector taken along a line 10-10 in FIG. 6 according the first embodiment of the present invention.

FIG. 9 is a sectional view showing the plug connector 20 and the receptacle connector 60 taken along a line 9-9 in FIG. 6 according to the first embodiment of the present invention. FIG. 10 is a sectional view showing the plug connector 20 and the receptacle connector 60 taken along a line 10-10 in FIG. 6 according the first embodiment of the present invention.

As shown in FIG. 7 and FIG. 8, the coaxial cable 24 is fixed to the plug signal terminal 23 of the plug connector 20. The coaxial cable 24 is supported and fixed integrally with a ground bar 34 at an external conductive member 41. The ground bar 34 is situated between the plug housing 21 and the plug shell 22. An upper portion of a core 35 exposed by removing a sheathe 36 is insulated with a covering portion 31. The covering portion 31 is formed by bending a portion of the plug housing 21. A lower portion of the core 35 is soldered to a predetermined portion of the plug signal terminal 23.

As shown in FIG. 7 and FIG. 8, the plug signal terminal 23 connected to the coaxial cable 24 is inserted into the recess portion 87 of the receptacle connector 60 together with the protruding portion 37, when the plug connector 20 is connected to the receptacle connector 60. As a result, the plug signal terminal 23 of the plug connector 20 can be connected to the receptacle signal terminal 63 of the receptacle connector 60 one-on-one, particularly through a connection with the contact portion 75 capable of elastic contact and protruding in the recess portion 87.

As shown in FIG. 9 and FIG. 10, when the plug connector 20 is connected to the receptacle connector 60, the ground terminal 64A enters the slit 30 located between the plug signal terminals 23A and 23B arranged next to each other, thereby separating the plug signal terminals 23A and 23B from each other in the direction of the arrow B, perpendicular to the aligning direction of the receptacle signal terminal 63 (shown with the arrow A).

Additionally, when the plug connector 20 is connected to the receptacle connector 60, the ground terminals 64B separate the plug signal terminals 23A and 23B at both of the outer sides thereof in the direction of the arrow B, perpendicular to the aligning direction of the receptacle signal terminal 63 (shown with the arrow A).

In other words, the protruding portion 37A with the plug signal terminal 23A and the protruding portion 37B with the plug signal terminals 23B are inserted into the recess portions 87A formed with the ground terminal 64A and one of the ground terminals 64B and 87B formed with the ground terminal 64A and another terminal 64B, respectively.

Consequently, the ground terminal 64 in the receptacle connector 60 not only separates the receptacle signal terminals 63 but also separates the plug signal terminals 23A and 23B in the plug connector 20 from each other and at both of the outer ends thereof in the direction of the arrow B, perpendicular to the aligning direction of the receptacle signal terminal 63 (shown with the arrow A). As a result, not only the receptacle signals 63, but also each of the plug signal terminals 23 can obtain higher shielding performance.

As shown in FIG. 7 and FIG. 8, it is preferable that the ground terminal 64 is sufficiently larger than the receptacle signal terminal 63 in size thereof, in order to increase shielding performance further.

Second Embodiment

A second embodiment of the present invention will be explained next.

In the first embodiment, the slit 30 is provided between the protruding portions 37 for fixing the plug signal terminals 23. The present invention is not limited to the first embodiment.

Figure 11:
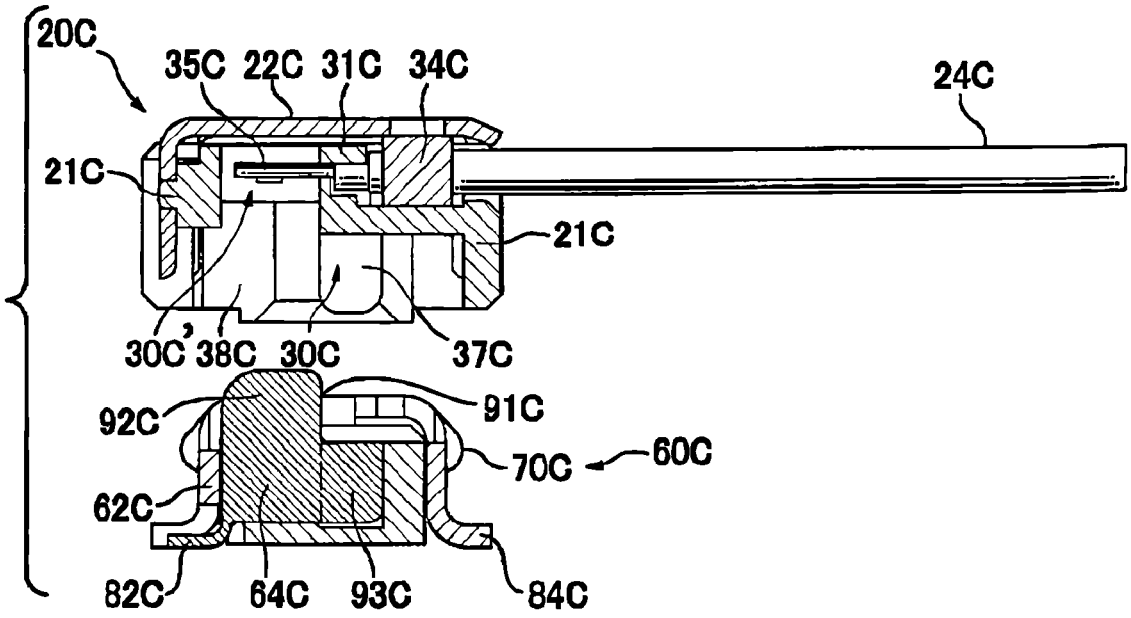
FIG. 11 is a sectional view showing a plug connector and a receptacle connector according to a second embodiment of the present invention.

FIG. 11 is a sectional view showing a plug connector 20C and a receptacle connector 60C according to a second embodiment of the present invention.

As shown in FIG. 11, as well as a slit 30C between protruding portions 37C of a plug housing 21C, a slit 30C' can be added to a main body portion 21C. In FIG. 11, each component corresponding to the component in FIG. 1 and so on has a corresponding number followed by suffix "C".

In the embodiment shown in FIG. 11, a ground terminal 64C has a larger step portion 91C and protrudes a larger portion 92C thereof toward a plug connector 20C so as to correspond to the slot 30C'. Thus the larger portion 92C protrudes from an upper portion of a receptacle shell 62C. Accordingly, when the plug connector 20C is connected to a receptacle connector 60C, a smaller portion 93C of the ground terminal 64C enters the slit 30C while the larger portion 92C enters the slit 30C'. As a result, in both of the plug connector 20C and the receptacle connector 60C, signal terminals arranged next to each other can be separated more sufficiently. Furthermore, cores 35C of coaxial cables 24C arranged next to each other can be separated as well. Therefore, it is possible to increase shielding performance thereof.

The disclosure of Japanese Patent Application No. 2008-223548, filed on Sep. 1, 2008 is incorporated in the application by reference.

While the invention has been explained with reference to the specific embodiments of the invention, the explanation is illustrative and the invention is limited only by the appended claims.

What is claimed is:

1. A connector device comprising:

a first connector including a first housing, a plurality of first signal terminals arranged in the first housing, and a first shell for covering an outer portion of the first housing, said first connector further including a protruding portion for arranging the first signal terminals; and a second connector to be connected to the first connector and including a second housing, a plurality of second signal terminals arranged in the second housing, a second shell for covering an outer portion of the second housing, and a first ground terminal disposed between the second signal terminals for separating the second signal terminals, said second signal terminals contacting with the first signal terminals when the first connector is connected to the second connector, said second connector further including a recess portion for receiving the protruding portion when the first connector is connected to the second connector.

2. The connector device according to claim 1, wherein said second housing includes second ground terminals disposed on both sides of the second signal terminals.

3. The connector device according to claim 1, wherein said first housing includes a first slit for receiving the first ground terminal when the first connector is connected to the second connector.

4. The connector device according to claim 2, wherein said first housing includes second slits for receiving the second ground terminals when the first connector is connected to the second connector.

5. The connector device according to claim 1, wherein said first ground terminal is formed in a plate shape.

6. The connector device according to claim 2, wherein said second ground terminals are formed in a plate shape.

7. The connector device according to claim 1, wherein said first ground terminal protrudes toward the recess portion.

8. The connector device according to claim 1, wherein said second shell is arranged to cover a side portion of the second housing.

9. The connector device according to claim 1, wherein said first shell is arranged to cover an upper portion of the second housing when the first connector is connected to the second connector.

10. The connector device according to claim 1, wherein said first ground terminal is arranged to connect electrically to the second shell.

11. The connector device according to claim 1, wherein said first shell is arranged to connect to the second shell when the first connector is connected to the second connector.

* * * * *